US006131805A

United States Patent [19]

Gasior

[11] Patent Number: 6,131,805

[45] Date of Patent: Oct. 17, 2000

[54] CONTAINER WITH REINFORCED CORNERPOST/WALL STRUCTURES AND BLANK FOR FORMING SAME

[75] Inventor: Wayne P. Gasior, Duluth, Ga.

[73] Assignee: Georgia-Pacific Corporation, Atlanta, Ga.

[21] Appl. No.: 09/422,939

[22] Filed: Oct. 22, 1999

[51] Int. Cl.[7] ..... B65D 21/032

[52] U.S. Cl. ..... 229/174; 229/191; 229/918

[58] Field of Search ..... 229/174, 182, 229/191, 915, 918, 919

[56] References Cited

U.S. PATENT DOCUMENTS

| | | | |
|---|---|---|---|
| 1,085,188 | 1/1914 | Arnold . | |
| 1,207,899 | 12/1916 | Greve . | |
| 1,653,116 | 12/1927 | Parks . | |
| 2,299,812 | 10/1942 | Ferguson . | |
| 2,588,455 | 9/1952 | Adams . | |
| 2,885,140 | 5/1959 | Guyer . | |
| 3,397,831 | 8/1968 | Adams . | |
| 3,784,082 | 1/1974 | Hurlock . | |
| 3,937,390 | 2/1976 | Winkler | 229/915 |
| 4,770,339 | 9/1988 | Weimer | 229/174 |
| 5,535,941 | 7/1996 | Garza . | |
| 5,673,848 | 10/1997 | Garza . | |
| 5,996,885 | 12/1999 | Chu | 229/191 |

FOREIGN PATENT DOCUMENTS

| | | | |
|---|---|---|---|
| 241336 | 7/1965 | Austria | 229/915 |
| 1439175 | 4/1966 | France | 229/918 |
| 556550 | 2/1957 | Italy | 229/918 |

*Primary Examiner*—Gary E. Elkins
*Attorney, Agent, or Firm*—Banner & Witcoff, Ltd.

[57] ABSTRACT

A shipping container, e.g., tray, formed-up from a unitary blank of sheet material improves upon known triangular cornerpost-type containers by providing reinforcing layers formed from a fold-over flap attached to an upper edge of a wall panel having post-forming corner panels at its lateral ends. The fold-over flap is laid-up against, and is secured to, a diagonal panel of the triangular post structures formed at each container corner, as well as adjacent portions of the corner-forming walls. Tabs formed by a hinged connection of the wall panel and fold-over panel are aligned with notches formed in lower edges of the walls, allowing for interengagement of multiple trays in a stacked configuration. The construction results in superior stacking strength and improved stacking stability, thereby facilitating material handling, shipping and display.

26 Claims, 6 Drawing Sheets

CONTAINER WITH REINFORCED CORNERPOST/WALL STRUCTURES AND BLANK FOR FORMING SAME

BACKGROUND OF THE INVENTION

The present invention relates to container constructions formed from blanks of sheet material, e.g., corrugated fiberboard and the like, and particularly to so-called cornerpost-style trays and boxes including corner reinforcement structures serving to increase container stacking strength and stability.

A variety of containers incorporating corner reinforcing structures are known. A particularly prevalent corner reinforcement configuration, used in trays and other types of containers, comprises a post structure formed from a corner flap extending laterally from the opposite ends of a container wall panel. The corner flap includes a pair of spaced score lines, in addition to a score line attaching the corner flap to the wall panel, demarcating a series of three corner panels. The corner flap is folded-back onto an inside surface of the wall panel and secured thereto, to thereby form (in conjunction with a corner portion of the wall panel) a tubular cornerpost configuration of triangular shape. An adjacent orthogonal wall panel (e.g., end wall or sidewall), folded-up from a floor of the container may be secured to an outer planar surface of the triangular cornerpost structure. Such a conventional construction is exemplified by the container disclosed in Parks U.S. Pat. No. 1,653,116, and is schematically illustrated in prior art FIG. 1.

As shown in FIG. 1, a conventional cornerpost-style tray comprises pairs of opposing sidewalls 1 and endwalls 3 folded-up from a floor panel (not shown). A plurality of corner panels 5*a*, 5*b* and 5*c* are attached along opposite lateral edges of each endwall 3. The corner panels are doubled-back onto an interior side of sidewall 3 to thereby form respective corner post structures 5 to which orthogonal sidewalls 1 are secured. The circular dots in FIG. 1 show where glue is typically applied to secure sidewalls 1 to each cornerpost structure 5, and to secure outermost corner panel 5*c* to the inside surface of endwall 3.

Numerous variations on this basic construction are known.

Ferguson U.S. Pat. No. 2,299,812 discloses triangular cornerpost members formed from pieces separate from the main box-forming blank, and secured by a hook structure of the box blank.

Guyer U.S. Pat. No. 2,885,140 discloses a diagonal cornerpost structure including, as shown in FIG. 8 thereof, a strap-like locking tab extending across the inside diagonal surface of each triangular post.

Adams U.S. Pat. No. 3,397,831 discloses cornerpost structures and wall reinforcements formed by separate pieces of material secured to a main box forming blank.

Garza U.S. Pat. Nos. 5,535,941 and 5,673,848 disclose triangular cornerpost structures with adjacent reinforcing panels.

Arnold U.S. Pat. No. 1,085,188 discloses a container with panels that fold over to form diagonal corner members. Specifically, blank sections fold over into overlapping relationship with adjacent end sections. The blank sections include wings which form, in a folded-over condition, diagonally extending partial-height corner pieces fitted within corresponding wall panel cut-outs.

SUMMARY OF THE INVENTION

In view of the foregoing, it is a principal object of the present invention to provide a cornerpost-style container, e.g., tray, having improved stacking strength and stability.

It is a more specific object of the invention to provide a container reinforcement configuration that enhances container stackability.

It is yet another object of the invention to provide a container as aforesaid, which can be easily formed-up from a unitary blank of scored and slotted sheet material, and which permits automated forming with only minor modification of existing container forming equipment and processes.

Still another object of the invention is to provide a blank for making a container as aforesaid, which blank is readily formable with efficient (low waste) usage of sheet material stock.

These and other objects are achieved in accordance with a first aspect of the present invention by a reinforced container comprising a floor and a plurality of walls connected to the floor. A plurality of corner panels are attached along a first lateral edge of a first one of the walls. The corner panels are doubled-back onto an interior side of the first wall to thereby form a first cornerpost structure to which a second wall adjacent the first wall is secured. A first fold-over flap is attached to an upper edge of the first wall. The fold-over flap includes a first major flap panel and a first series of minor flap panels attached to a first lateral edge of the major flap panel, laid-up against and serving to reinforce, respectively, at least portions of the first wall, the cornerpost structure and the second wall. In another aspect, the invention is embodied in a sheet material blank for forming a reinforced container as aforesaid.

In yet another aspect, the invention is embodied in a stackable reinforced sheet material container. The container includes a floor panel and a plurality of wall panels connected to the floor panel. A fold-over flap is attached to an upper edge of at least one of the wall panels and is folded-over into overlapping relation with the wall panel. The fold-over flap is hingedly connected to the wall panel by at least one hinge flap pair. The hinge flap pair forms a tab protruding upwardly from a top edge of the first wall panel, and a bottom edge of the wall panel has a notch formed in alignment with the tab, whereby when a first one of the containers is stacked upon a second one of the containers, an interengagement of the containers is provided by the tab on the second container being received within a corresponding notch of the first container.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
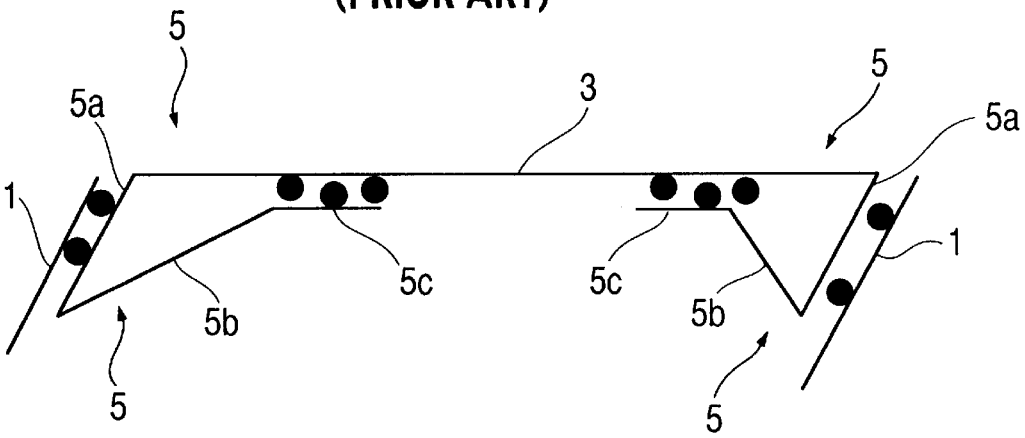
FIG. 1 (PRIOR ART)
FIG. 1 is a schematic view illustrating a panel layout of a conventional (prior art) cornerpost-style container.
Figure 2:
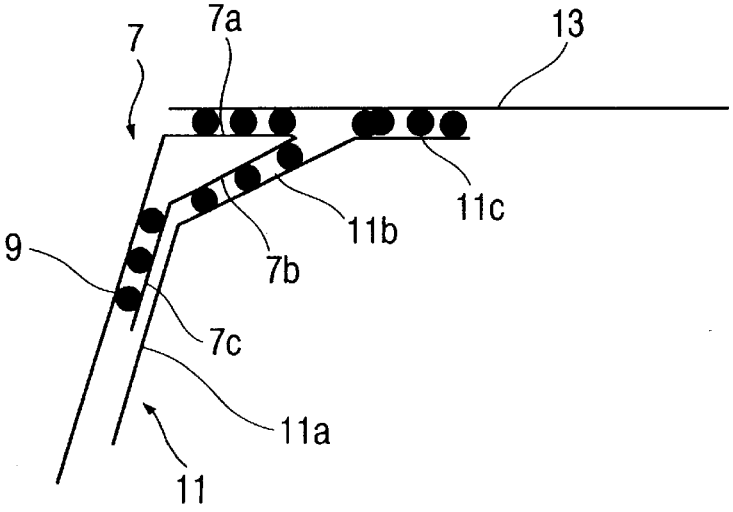
FIG. 2 is a schematic view illustrating a panel layout of a cornerpost-style container in accordance with the present invention.

Conceptually, the reinforcement features of the present invention are best understood with reference to FIG. 2. The present invention builds upon the conventional structure shown in FIG. 1 to provide a cornerpost-style tray with enhanced stacking strength and stability. As shown in FIG. 2, a cornerpost structure 7, similar to cornerpost structure 5 of FIG. 1, is formed-up from doubled-back corner panels attached to a lateral edge of a sidewall 9. Sidewall 9, as well as cornerpost structure 7, is reinforced by a fold-over flap 11 attached to an upper edge of sidewall 9. Fold-over flap 11 includes a major flap panel 11*a*, and first and second minor flap panels 11*b*, 11*c* attached to a lateral edge of major flap panel 11*a*. These panels are laid-up against, and serve to reinforce, respectively, at least portions of sidewall 9, cornerpost structure 7 (specifically diagonal panel 7*b* thereof) and orthogonal endwall 13. In addition to their reinforcing functionality, the panels of sheet material added by fold-over flap 11 result in a greater depth (thickness) of portions of the container's upper perimetric edge, thereby providing larger contact areas for stacked trays to rest one upon another, and thus improved stacking stability.

While FIG. 2 shows cornerpost structure 7 formed-up as part of sidewall 9, it will be understood that similar results can be achieved by forming-up cornerpost structure 7 as part of endwall 13, e.g., in the general arrangement shown in prior art FIG. 1. As a matter of consistent nomenclature, the term "sidewall" is used herein to refer to the longer walls of a (non-square) rectangular container, and the term "endwall" is used to refer to the shorter walls.

As in FIG. 1, the dots in FIG. 2 depict preferred locations for application of adhesive, e.g., glue, to securely hold the walls, cornerpost, and reinforcing structures in place. Particularly, glue may be applied between sidewall 9 and corner panel 7*c*, between endwall 13 and the outside surface of corner panel 7*a*, between corner panel 7*b* and minor flap panel 11*b*, and between endwall 13 and minor flap panel 11*c*.

Figure 3:
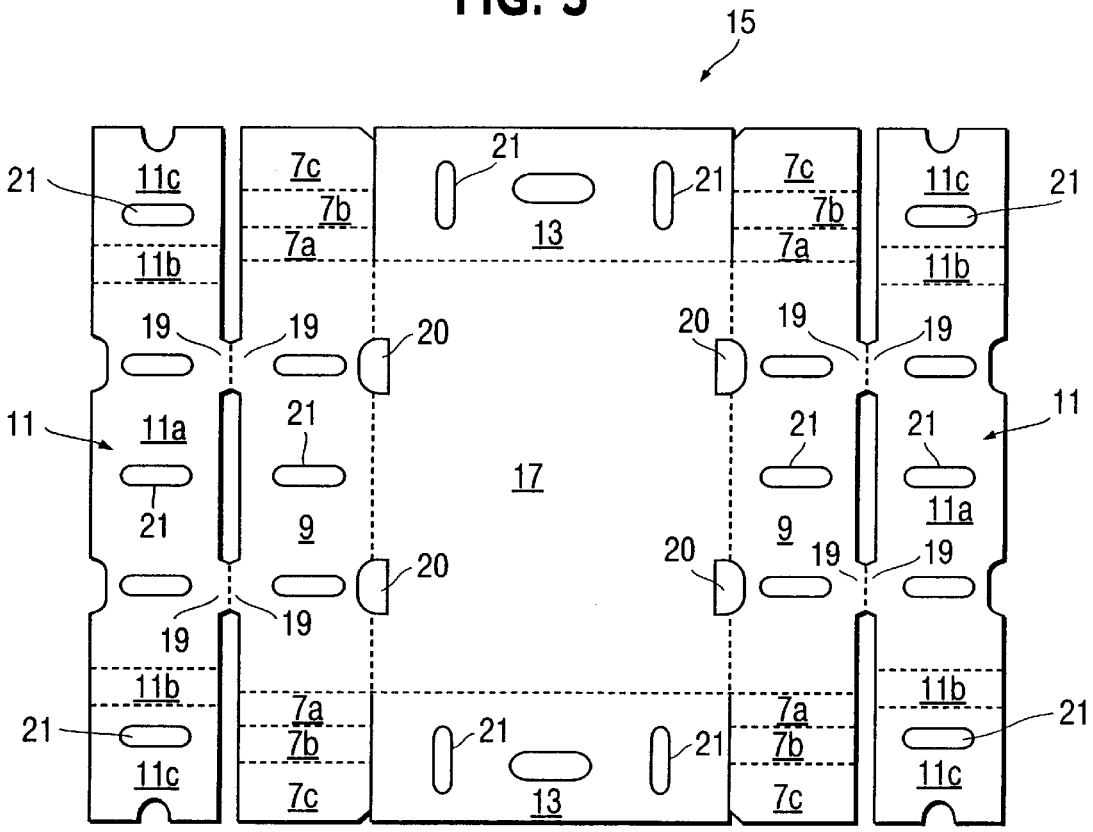
FIG. 3 is a top plan view of a unitary blank in accordance with the present invention for forming a cornerpost-style tray.

Referring now to FIG. 3, illustrated is a unitary blank in accordance with the present invention, from which a cornerpost-style tray having a corner configuration as shown in FIG. 2 may be formed. The blank shown is exemplary and is used to form a shallow ventilated rectangular tray with equal height sides, well suited for shipping of produce and the like. It will be understood that the invention is not limited to this particular type of container, and may in fact be embodied in a variety of container styles and sizes, including relatively deeper box-like containers, and trays having sidewalls/endwalls of differing heights, e.g., display-type trays with abbreviated sidewalls and taller endwalls. In typical applications, a cornerpost structure 7 will be formed-up at each corner of a rectangular (possibly square) container. Again, however, the invention is not so limited. In accordance with the present invention, a reinforced cornerpost/wall structure may be provided at less than each of the four corners of a rectangular container, or at some or all corners of a container having a non-rectangular shape, e.g., a container of hexagonal or octagonal footprint.

As seen in FIG. 3, blank 15 comprises a central floor panel 17, a pair of opposed endwall panels 13, and a pair of opposed sidewall panels 9. The dotted lines in FIG. 3 denote scored fold lines attaching the respective panels. Attached along the opposed lateral edges of each one of sidewall forming panels 9 are corner panels 7*a*, 7*b* and 7*c* which, when doubled-back onto an interior side of sidewall panels 9, form respective cornerpost structures 7, to which endwall panels 13 may be secured.

Figure 8:
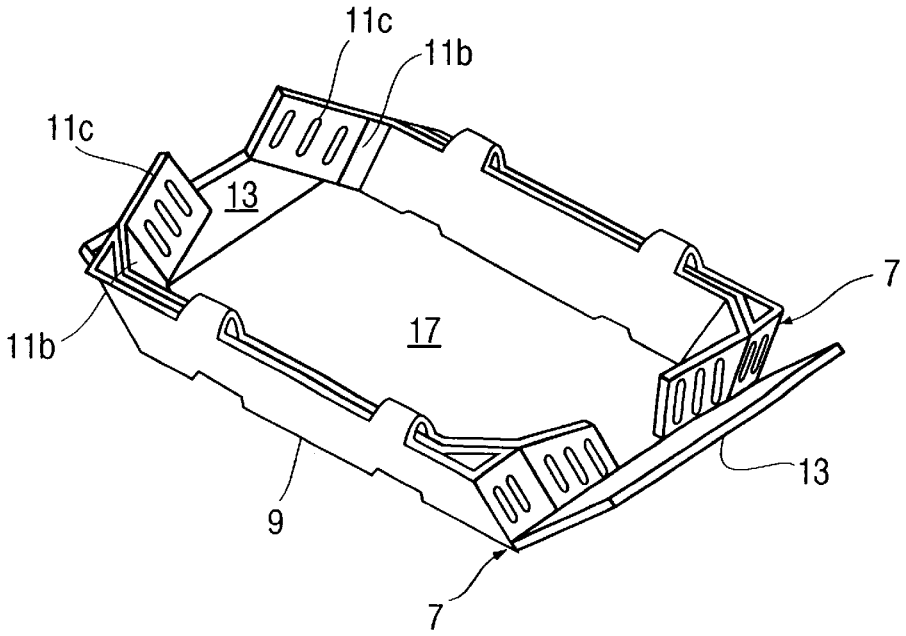
Figure 9:
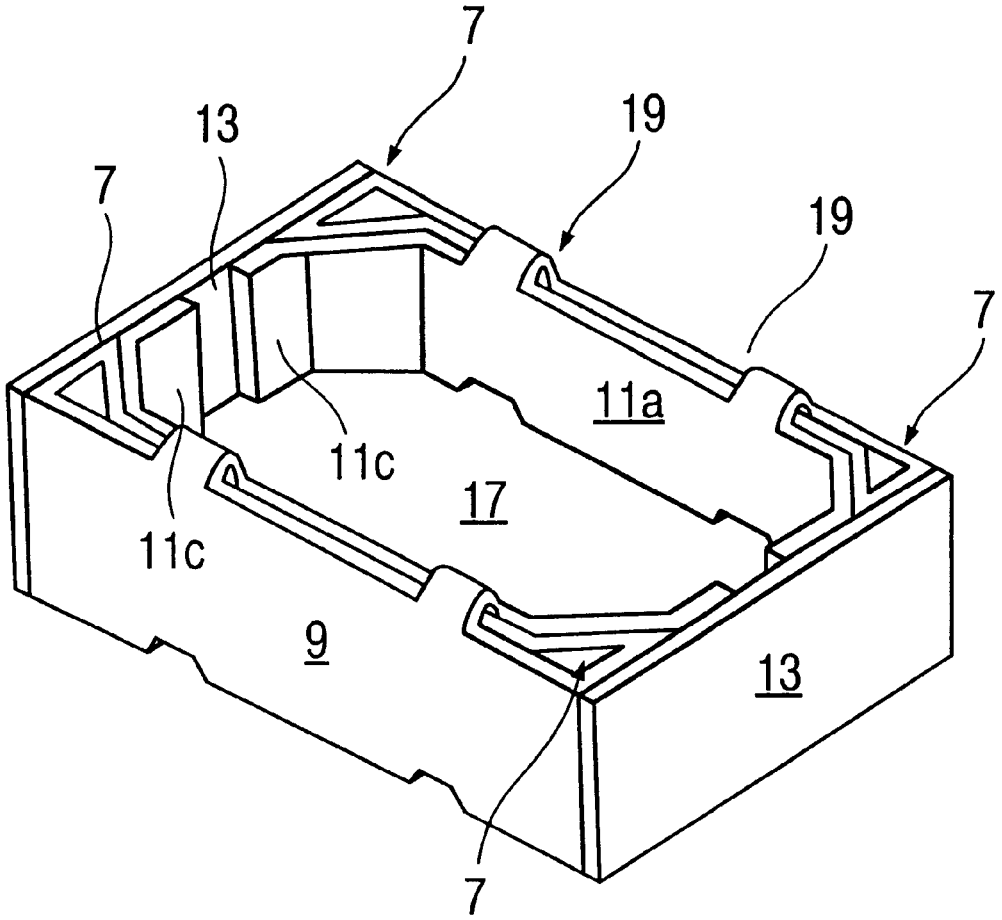

Fold-over flaps 11 are attached to an outer (ultimately upper) edge of each sidewall panel 9. In the preferred illustrated embodiment, this attachment is effected by way of spaced interconnected hinge flap pairs 19. As seen in FIGS. 8 and 9, when the blank is formed-up into a tray, hinge flap pairs 19 form respective tabs protruding upwardly from top edges of container sidewalls 9. Cut-outs 20 are provided in alignment with these tabs, on the score lines formed between floor panel 17 and sidewall panels 9, such that in the finished container (see FIG. 9), respective bottom edges of tray sidewalls 9 have a pair of notches formed in alignment with the tabs. This feature allows multiple containers to be stacked, one upon the other, with an interengagement of the containers being provided by the tabs on the lower tray being received within corresponding ones of the notches of an upper tray.

Each fold-over flap 11 includes a major flap panel 11*a*. Attached to opposite lateral edges of major flap 11*a* are first and second minor flap panels 11*b*, 11*c*. As described in connection with FIG. 2 (and as also seen in FIG. 9), in the completed tray major flap panel 11*a* is laid-up against, and serves to reinforce, a corresponding sidewall 9, and minor flap panels 11*b*, 11*c* are laid-up against and serve to reinforce, respectively, cornerpost structure 7 and adjacent orthogonal endwall 13.

In the illustrated embodiment, major flap panels 11*a* are configured to be substantially co-extensive with (i.e., having substantially identical area, height and width as) the portions of sidewall panels 9 that will reside, in the completed tray, between cornerpost structures 7. Minor flap panels 11*b* also preferably have a height and width corresponding to that of diagonal corner panels 7*b*. As shown, outermost minor flap panels 11*c* have a height corresponding to that of endwalls 13, and a width that leaves, in the finished tray, a small central strip of each endwall 13 uncovered.

It will be understood that the invention is not limited to the illustrated relative dimensions. For example, while corresponding heights of the overlapping panels is generally desirable for maximizing stacking strength, applications are envisioned where lesser strengths requirements would permit a saving of sheet material stock by sizing one or more of the panels of fold-over flap 11 to be less than fully co-extensive with the corresponding panels against which they are laid-up, e.g., of lesser height.

A plurality of spaced elongated apertures 21 are provided in sidewall panels 9 and endwall panels 13, in order to provide ventilation openings in the finished container. The apertures in sidewall panels 9 and endwall panel 13 are positioned relative to apertures 21 provided in major flap panels 11*a* and minor flap panels 11*c* such that in the finished container respective pairs of apertures are positioned in registry with each other, to provide unobstructed container ventilation openings. Additionally, similar horizontally extending elongated apertures are centrally located in endwalls 13 to provide container hand-holds.

Sequential steps for forming-up a tray from blank 15 are now described, with reference to FIGS. 4–9. Typically, these steps will be carried out in an automated process using methods and techniques known in the art. Of course, the forming process may also be performed manually. Advantageously, the manufacture of containers from blanks in accordance with the present invention can be carried out with relatively straightforward modification of existing apparatus and processes, e.g., of the type used to form-up conventional cornerpost-style trays as shown in FIG. 1. Primarily, an additional folding section is required to fold over and properly secure fold-over panel 11. Suitable forming machinery can, e.g., be manufactured by Southern Packaging Machinery Company, Florida City, Fla.; R.A.

Pearson Company, Spokane, Wash.; and Wayne Automation Corp., Norristown, Pa.

Figure 4:
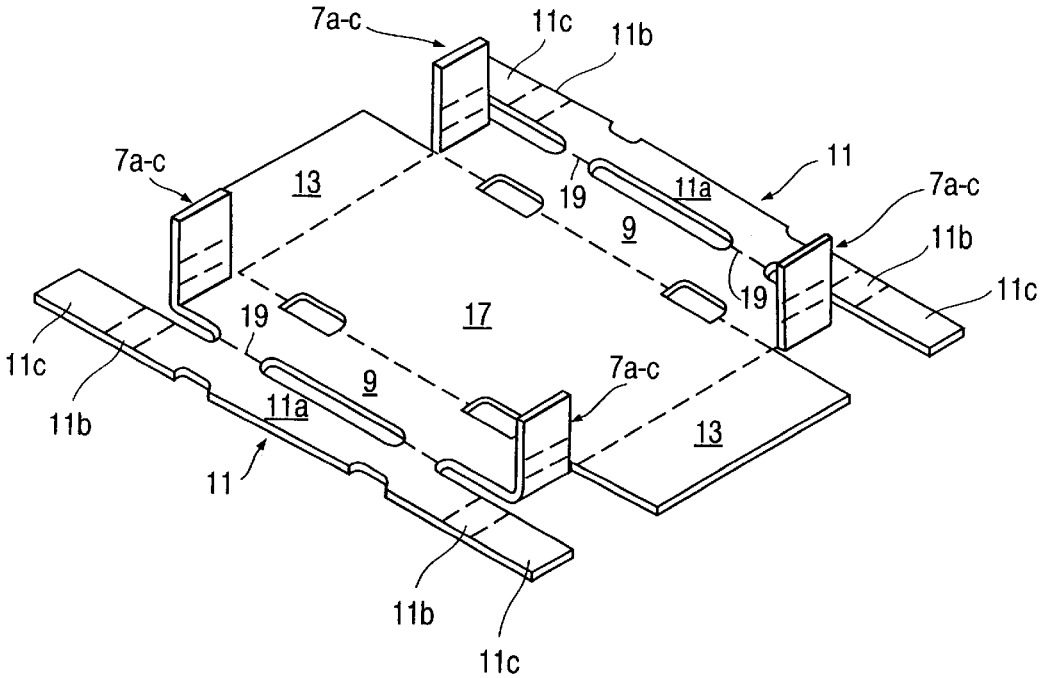
FIGS. 4–9 are perspective views illustrating sequential stages in the forming-up of a cornerpost-style tray from a blank of the general type shown in FIG. 3.
Figure 5:
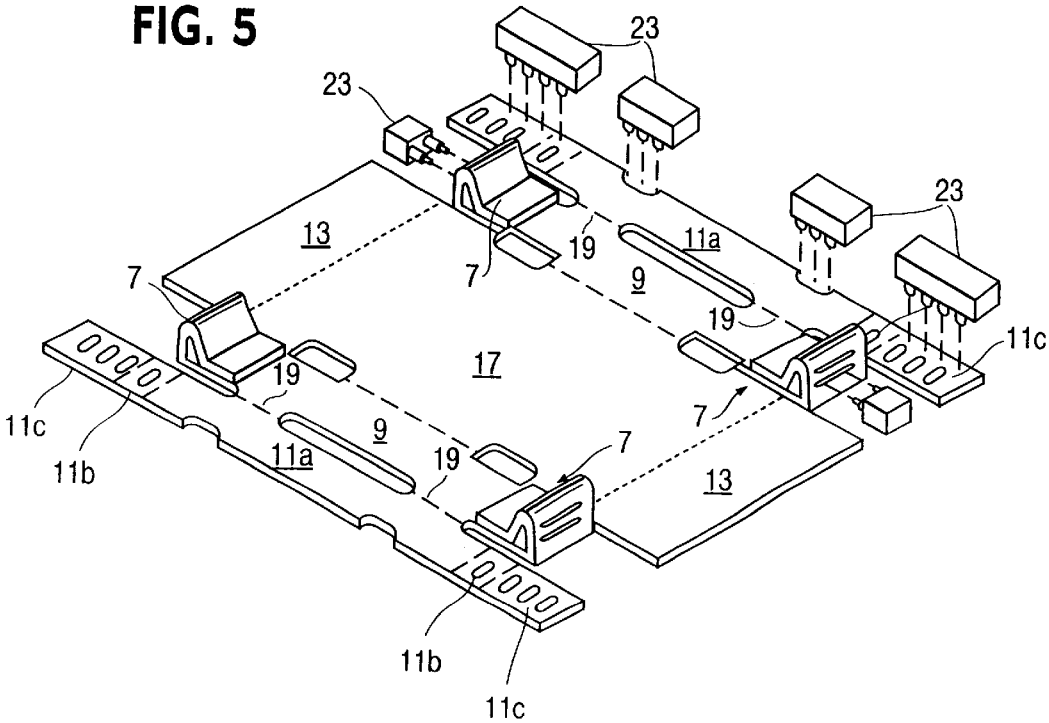

Initially, as seen in FIG. 4, corner panels 7*a–c* are bent upwardly to an upstanding position perpendicular to the plane of the remaining panels of the blank, along the fold line provided between sidewall panel 9 and innermost corner panel 7*a*. Next, as shown in FIG. 5, the triangular tubular shape of each cornerpost structure 7 is formed-up by doubling-back corner panels 7*b* and *c*, and by securing with adhesive, stapling, etc. corner panel 7*c* to an adjacent end portion of sidewall panel 9. A plurality of glue applicators 23 are schematically illustrated in FIG. 5. These applicators preferably serve to apply glue to facing surfaces of minor flap panels 11*b*, 11*c*, and each of corner flap panels 7*a*, to provide adhesive interfaces as shown in FIG. 2. Glue may, if desired, also be applied to major flap panel 11*a* for securement to sidewall panel 9.

Figure 6:
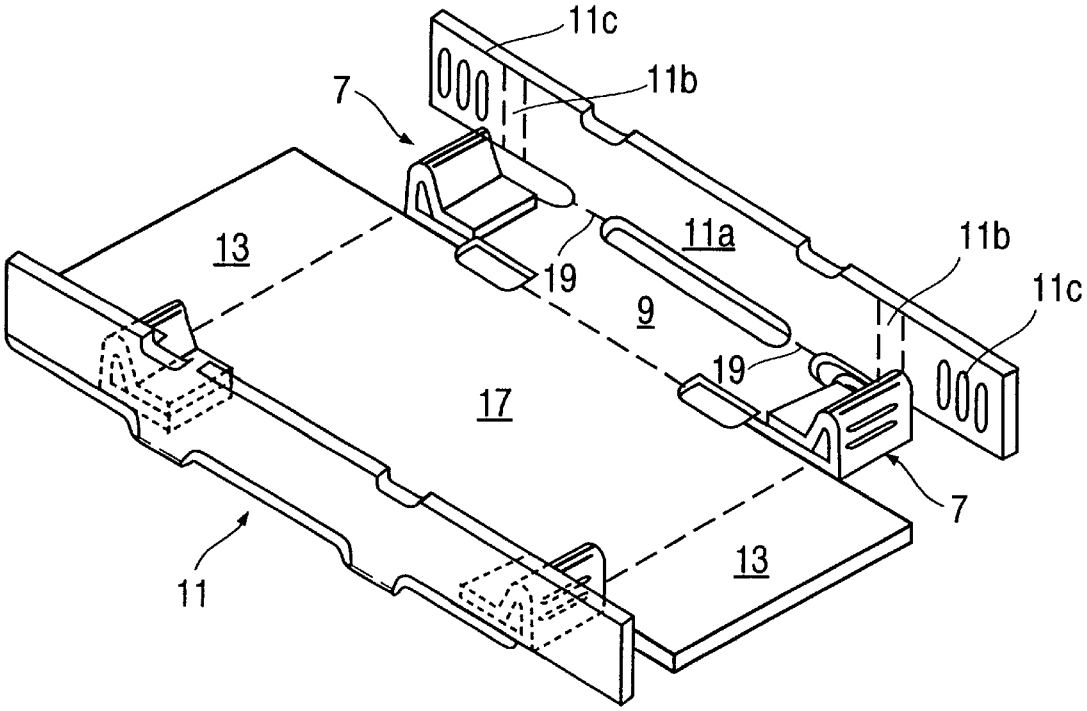
Figure 7:
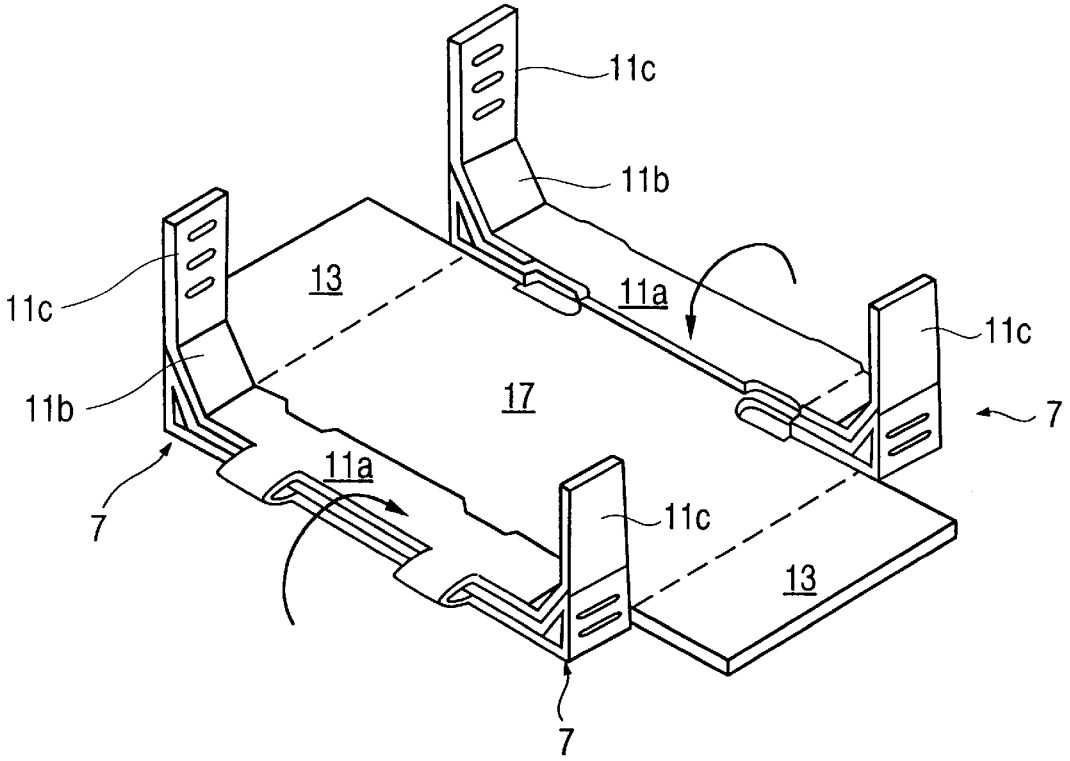

With reference to FIGS. 6 and 7, it can be seen that fold-over flaps 11 are folded (rotated) onto, and thus laid-up against, sidewall panels 9 and cornerpost structure 7. Folds are effected along the score lines demarcating minor flap panels 11*b*, in correspondence with the upward diagonal extension of intermediate corner panels 7*b*, to thus place minor panels 11*c* in the illustrated upright positions shown in FIG. 7.

Next, the resultant composite reinforced sidewall/cornerpost structures are rotated into respective upright positions about the respective score lines provided between floor panel 17 and sidewall panels 9. This rotation places cornerpost structure 7 and minor flap panels 11*c* in their final position, with their glue covered faces in position for adhesive securement to facing surfaces of endwall panels 13. In a conventional manner, each of the areas of adhesive securement is pressed by a ram or the like to ensure bonds of high strength and integrity, resulting in the finished container shown in FIG. 9.

The present invention has been described in terms of preferred and exemplary embodiments thereof Numerous other embodiments, modifications and variations within the scope and spirit of the appended claims will occur to persons of ordinary skill in the art from a review of this disclosure.

What is claimed is:

1. A reinforced container comprising:

a floor and a plurality of walls connected to said floor;

a plurality of corner panels attached along a first lateral edge of a first one of said walls, said corner panels being doubled-back onto an interior side of the first wall to thereby form a first cornerpost structure to which a second wall adjacent said first wall is secured;

a first fold-over flap attached to an upper edge of said first wall, said fold-over flap including a first major flap panel and a first series of minor flap panels attached to a first lateral edge of said major flap panel, laid-up against and serving to reinforce, respectively, at least portions of said first wall, said cornerpost structure and said second wall.

2. A reinforced container according to claim 1, wherein said plurality of corner panels comprise two corner flap panels forming, together with said first wall panel, a cornerpost structure having a triangular tubular shape, and a third corner flap secured to an inside surface of said first wall.

3. A reinforced container according to claim 2, wherein said series of minor flap panels comprises a first minor flap panel laid-up against, and secured to an inside surface of, a diagonally extending one of said corner flap panels, and a second minor flap panel laid-up against and secured to an inside surface of said second wall.

4. A reinforced container according to claim 1, wherein said first major flap panel has a height substantially equal to a height of said first wall, and each of said series of minor flap panels has a height substantially equal to a corresponding underlying one of said corner flap panels and said second wall.

5. A reinforced container according to claim 1, wherein said first fold-over flap is hingedly connected to said first wall by spaced hinge flap pairs connecting said first wall to said first major flap panel.

6. A reinforced container according to claim 5, wherein each of said hinge flap pairs forms a tab protruding upwardly from a top edge of said first wall, and a bottom edge of said first wall has a pair of notches formed in alignment with said tabs, respectively, whereby when a first one of said containers is stacked upon a second one of said containers, an interengagement of the containers is provided by the tabs on said second container being received within corresponding ones of the notches of said first container.

7. A reinforced container according to claim 1, wherein said first wall and said first major flap panel have respective apertures which are positioned in registry with each other to provide a container ventilation opening.

8. A reinforced container according to claim 1, wherein said second wall and the minor flap panel laid-up against said second wall have respective apertures which are positioned in registry with each other to provide a container ventilation opening.

9. A reinforced container according to claim 1, wherein said first wall and said second wall are of substantially equal height.

10. A reinforced container according to claim 9, wherein all of said container walls are of substantially equal height.

11. A reinforced container according to claim 1, wherein said container has a rectangular footprint.

12. A reinforced container according to claim 1, wherein a second plurality of corner panels is attached to a second lateral edge of said first wall opposite said first lateral edge, said second corner panels being doubled back onto said interior side of the first wall to thereby form a second cornerpost structure to which a third wall adjacent said first wall is secured, said fold-over flap including a second series of minor flap panels attached to a second lateral edge of said first major flap panel opposite said first lateral edge of the first flap panel, laid-up against and serving to reinforce at least a portion of said second cornerpost structure and said third wall.

13. A reinforced container according to claim 12, wherein a width of said first major flap panel is substantially equal to a width of that portion of the first wall residing between the first and second cornerpost structures.

14. A reinforced container according to claim 1, wherein a second plurality of corner panels is attached to a lateral edge of a third one of said walls opposite said first wall, said second corner panels being doubled-back onto said interior side of the third wall to thereby form a second cornerpost structure to which said second wall is secured, said third wall including a second fold-over flap attached to an upper edge of said third wall, said second fold-over flap including a second major flap panel and a second series of minor flaps panels attached to a first lateral edge of said second major flap panel, laid-up against and serving to reinforce, respectively, at least portions of said third wall, said second cornerpost structure and said second wall.

15. A reinforced container according to claim 14, wherein:

a third plurality of corner panels is attached to a second lateral edge of said first wall opposite the first lateral edge of the first wall, said third plurality of corner panels being doubled-back onto said interior side of the first wall to thereby form a third cornerpost structure to which a fourth sidewall adjacent said first wall and opposite said second wall is secured, said first fold-over flap including a third series of minor flap panels attached to a second lateral edge of said first major flap panel opposite said first lateral edge of the first major flap panel, laid-up against and serving to reinforce at least portions of said third cornerpost structure and said fourth wall; and a fourth plurality of corner panels attached to a second lateral edge of said third wall opposite said first lateral edge of the third wall, said fourth plurality of corner panels being doubled-back onto said interior side of said third wall to thereby form a fourth cornerpost structure to which said fourth wall is secured, said second fold-over flap including a fourth series of minor flap panels attached to a second lateral edge of said second major flap panel opposite said first lateral edge of the second major flap panel, laid-up against and serving to reinforce, respectively, at least portions of said fourth cornerpost structure and said fourth wall.

16. A sheet material blank for forming a reinforced container, said blank comprising:

a floor panel and a plurality of wall panels connected to said floor panel;

a plurality of corner panels attached along a first lateral edge of a first one of said wall panels, said corner panels being configured to be doubled-back onto an interior side of the first wall panel to thereby form, in a formed-up container, a first cornerpost structure to which a second wall panel adjacent said first wall panel may be secured;

a first fold-over flap attached to an upper edge of said first wall panel, said fold-over flap including a first major flap panel and a first series of minor flap panels attached to a first lateral edge of said major flap panel, said first major flap panel and said minor flap panels being configured to be laid-up against and to reinforce, respectively, at least portions of said first wall panel, said cornerpost structure and said second wall panel.

17. A sheet material blank according to claim 16, wherein said plurality of corner panels comprise two corner flap panels serving to form, together with said first wall panel, a cornerpost structure having a triangular tubular shape, and a third corner flap securable to an inside surface of said first wall panel.

18. A sheet material blank according to claim 17, wherein said series of minor flap panels comprises a first minor flap panel that can be laid-up against, and secured to an inside surface of, a diagonally extending one of said corner flap panels, and a second minor flap panel that can be laid-up against and secured to an inside surface of said second wall panel.

19. A sheet material blank according to claim 16, wherein said first major flap panel has a height substantially equal to a height of said first wall panel, and each of said series of minor flap panels has a height substantially equal to a corresponding one of said corner flap panels and said second wall panel.

20. A sheet material blank according to claim 16, wherein said first fold-over flap is hingedly connected to said first wall panel by spaced hinge flap pairs connecting said first wall panel to said first major flap panel.

21. A sheet material blank according to claim 20, wherein each of said hinge flap pairs forms, in a formed-up container, a tab protruding upwardly from a top edge of said first wall panel, and a bottom edge of said first wall panel has a pair of notches formed in alignment with said tabs, respectively, whereby when a first one of said containers is stacked upon a second one of said containers, an interengagement of the containers is provided by the tabs on said second container being received within corresponding ones of the notches of said first container.

22. A sheet material blank according to claim 16, wherein said first wall panel and said first major flap panel have respective apertures which are, in a formed-up container, positioned in registry with each other to provide a container ventilation opening.

23. A sheet material blank according to claim 16, wherein said second wall panel and the minor flap panel to be laid-up against said second wall panel have respective apertures which are, in a formed-up container, positioned in registry with each other to provide a container ventilation opening.

24. A sheet material blank according to claim 16, wherein said first wall panel and said second wall panel are of substantially equal height.

25. A sheet material blank according to claim 24, wherein all of said container wall panels are of substantially equal height.

26. A sheet material blank according to claim 16, wherein a container formed up from the blank has a rectangular footprint.

* * * * *